US008181368B2

(12) United States Patent
Spatz et al.

(10) Patent No.: US 8,181,368 B2
(45) Date of Patent: May 22, 2012

(54) STEAM IRON WITH TANK INCLUDING OVERPRESSURE SAFETY DEVICE

(75) Inventors: Dierk Spatz, Erbach (DE); Wolfgang Keller, Breuberg (DE); Jochen Weber, Brombachtal (DE)

(73) Assignee: Rowenta Werke GmbH, Offenbach (DE)

( * ) Notice: Subject to any disclaimer, the term of this patent is extended or adjusted under 35 U.S.C. 154(b) by 316 days.

(21) Appl. No.: 12/530,718

(22) PCT Filed: Feb. 28, 2008

(86) PCT No.: PCT/IB2008/000566

§ 371 (c)(1),
(2), (4) Date: Oct. 14, 2009

(87) PCT Pub. No.: WO2008/110897

PCT Pub. Date: Sep. 18, 2008

(65) Prior Publication Data

US 2010/0107458 A1 May 6, 2010

(30) Foreign Application Priority Data

Mar. 14, 2007 (FR) ..... 07 01838

(51) Int. Cl.
*D06F 75/24* (2006.01)
*D06F 75/22* (2006.01)

(52) U.S. Cl. ..... 38/77.81

(58) Field of Classification Search ..... 38/74–77.83
See application file for complete search history.

(56) References Cited

U.S. PATENT DOCUMENTS

| | | | | |
|---|---|---|---|---|
| 2,188,010 | A * | 1/1940 | Miller | 38/77.8 |
| 2,240,612 | A * | 5/1941 | Ekstedt | 38/77.81 |
| 2,475,572 | A | 7/1949 | Schreyer | |
| 2,618,875 | A * | 11/1952 | Vieceli | 38/77.81 |
| 2,682,719 | A | 7/1954 | Cone | |
| 2,762,143 | A * | 9/1956 | Hoecker | 38/77.5 |
| 4,571,862 | A * | 2/1986 | Costa | 38/77.81 |
| 4,920,668 | A * | 5/1990 | Henneberger et al. | 38/77.81 |

FOREIGN PATENT DOCUMENTS

| | | |
|---|---|---|
| GB | 597209 A | 1/1948 |
| GB | 2168081 A | 6/1986 |

* cited by examiner

*Primary Examiner* — Ismael Izaguirre
(74) *Attorney, Agent, or Firm* — Browdy and Neimark, PLLC

(57) ABSTRACT

The invention relates to a steam iron that comprises a housing including a tank (5) above a heating body and a safety device that protects the tank (5) against overpressure, the heating body (3) comprising a vaporization chamber supplied with liquid from the tank (5) by a supply circuit, characterized in that said supply circuit includes a member (93) extending inside the tank (5) and having an opening (12) blocked by a valve (94A), said valve (94A) opening a passage through said opening (12) when the pressure inside the tank (5) reaches a predetermined value.

14 Claims, 4 Drawing Sheets

STEAM IRON WITH TANK INCLUDING OVERPRESSURE SAFETY DEVICE

This invention concerns steam irons having a body enclosing a tank above a heating body and relates more particularly in an iron including a tank fitted with an overpressure safety device, the overpressures being able to be created notably by a rise in the temperature of the tank when the supply valve for the steam chamber and the filling opening for the tank are closed.

There is known, from the document GB 597 209, a steam iron with a body enclosing a water tank above a heating body and a vent device permitting too high a pressure in the tank to be avoided. In this document, the outlet of the vent is equipped with a baffle to prevent steam generated in the tank from being projected onto the hands.

However, such a vent has the disadvantage of allowing water in the tank to escape through the vent during ironing. In addition, in the case of an increase in the temperature in the tank, steam and water projections through the vent remain dangerous and are not well received by the user.

Thus, the goal of the present invention is to remedy these disadvantages by proposing an iron with a tank fitted with an overpressure safety device that is simple and economical to produce. Another goal of the present invention is to propose a safety device that allows steam to escape in the direction of the steam chamber when an overpressure exists in the tank to allow the evaporation of any water droplets and evacuation of the steam through holes in the soleplate.

The purpose of the invention is achieved by a steam iron comprising a housing enclosing a tank above a heating body and a safety device protecting the tank against overpressure, the heating body having a steam chamber supplied with liquid from the tank by a supply circuit, wherein the supply circuit has an element extending to the interior of the tank and having an opening blocked by a valve, the valve unblocking a passage through the opening when the pressure reigning at the interior of the tank reaches a predetermined value.

Such feature allows, by a simple and inexpensive means, diffusion of overpressure steam from the tank in the direction of the steam chamber so that steam gradually escapes through the steam outlet holes in the soleplate, without risk of spraying of droplets of boiling water, these latter being vaporized in the steam chamber.

According to another characteristic of the invention, the supply system links a pump, or a drip valve, to the steam chamber.

According to another characteristic of the invention, the supply system links a manual pump to the steam chamber, the pump being equipped with a check valve, the opening being disposed downstream of the check valve.

According to another characteristic of the invention, the element having the opening blocked by the valve is a connection sleeve for the pump outlet.

According to another characteristic of the invention, the valve is formed by a wall capable of deforming elastically when the pressure within the tank reaches the predetermined value.

According to yet another characteristic of the invention, the wall is carried by a rubber body.

Another characteristic of the invention, the rubber body is a sealing joint.

One will better understand the goals, aspects and benefits of the present invention from the description given below of a particular embodiment of the invention presented as a non-limiting example by referring to the annexed drawings in which.

Only the elements necessary for understanding the invention have been represented. To facilitate reading of the drawings, the same elements have the same references from one figure to another.

Figure 1:
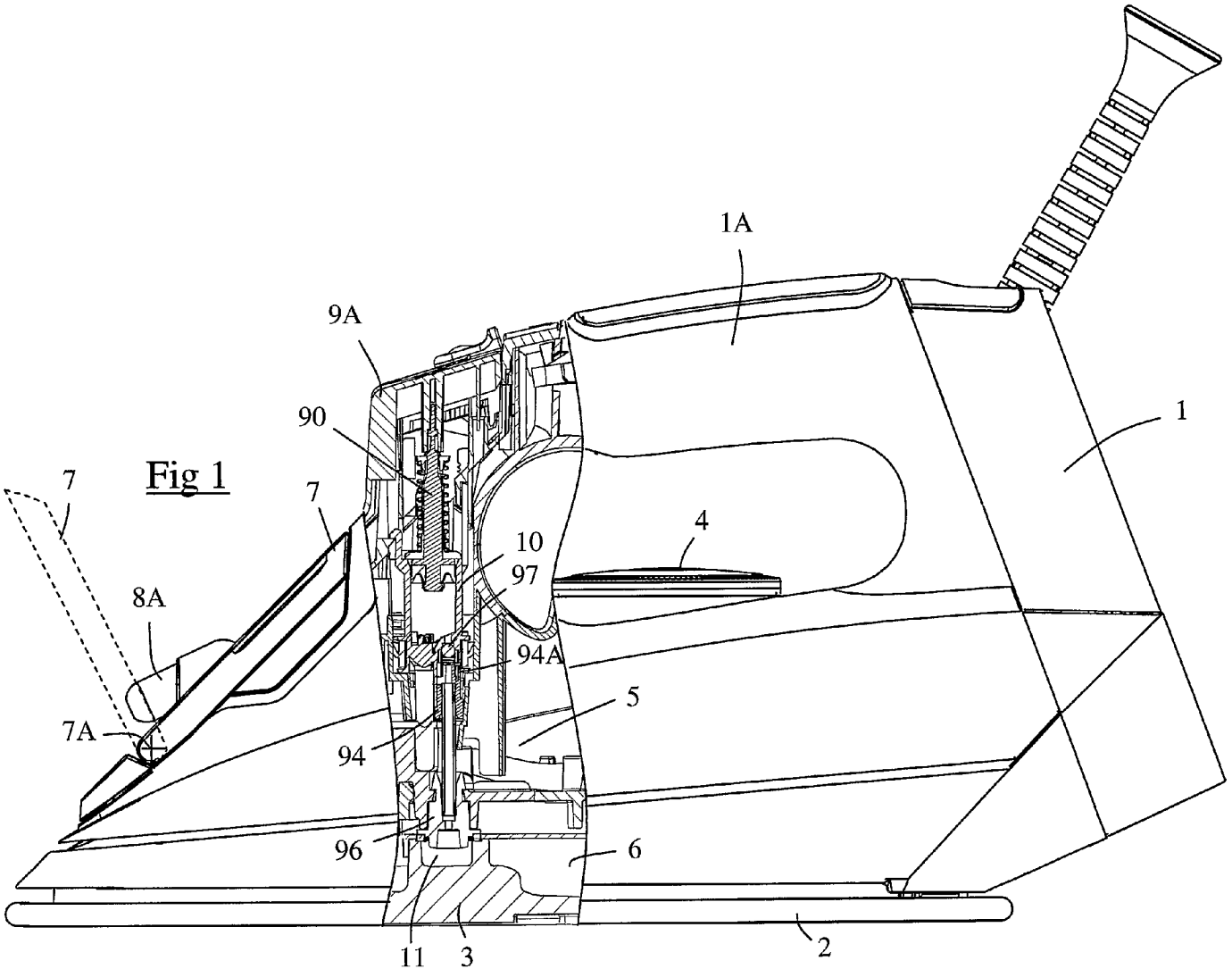
FIG. 1 is a side view, partly in cross section, of a steam iron according to a particular embodiment of the invention.
Figure 2:
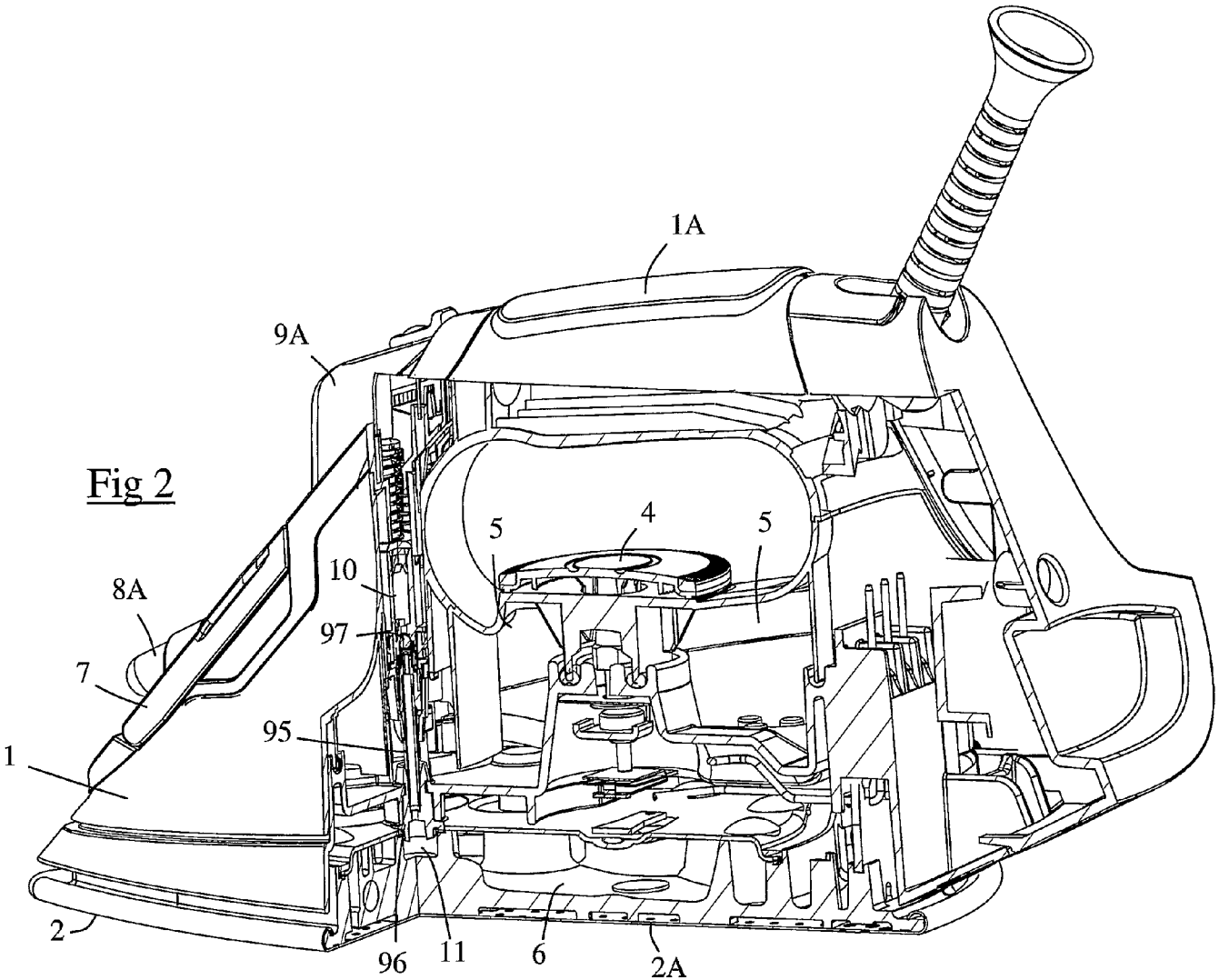
FIG. 2 is a perspective view, partly broken away, of the iron of FIG. 1.

FIGS. 1 and 2 represent a steam iron having a housing 1 furnished with a grasping handle 1A, the housing being above a soleplate 2 in thermal conduction with a heating body 3, the temperature of which is regulated by a thermostat 4.

According to these figures, housing 1 conventionally contains a tank 5 serving to feed a first steam chamber 6 through a drip valve, not shown in the figures, the steam thus produced escaping through outlet holes 2A of the soleplate.

Tank 5 is furnished with a filling hole that is hidden by a trap 7 disposed on the front face of the iron assuring a watertight closing of the filling hole, trap 7 being able to rock around an axis 7A toward an open position, shown in broken lines in FIG. 1, to allow filling of tank 5.

The iron has, as known per se, a first manual pump 8, not visible in FIGS. 1 and 2, permitting water to be sent from tank 5 in the direction of a spray nozzle 8A disposed on the front face of the iron, this pump 8 being actuated by the user by means of a button, not visible in the figures, disposed in front of handle 1A.

The iron also has a second manual pump 9 supplied with water from tank 5 and actuatable by the user by means of a button 9A, each press on button 9A permitting the delivery of a predetermined volume of water into a second steam chamber 11 permitting the production of a surplus of steam during ironing.

Figure 3:
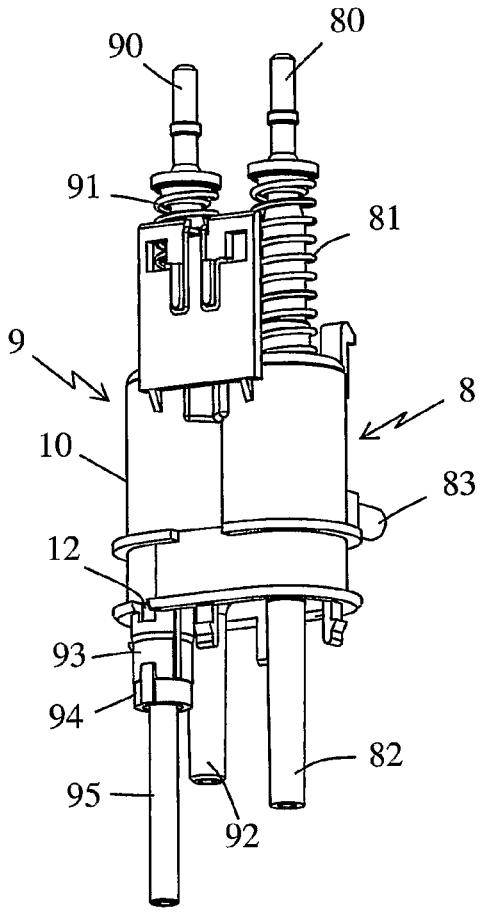
FIG. 3 is a perspective view of the manual pump of the iron of FIG. 1.
Figure 4:
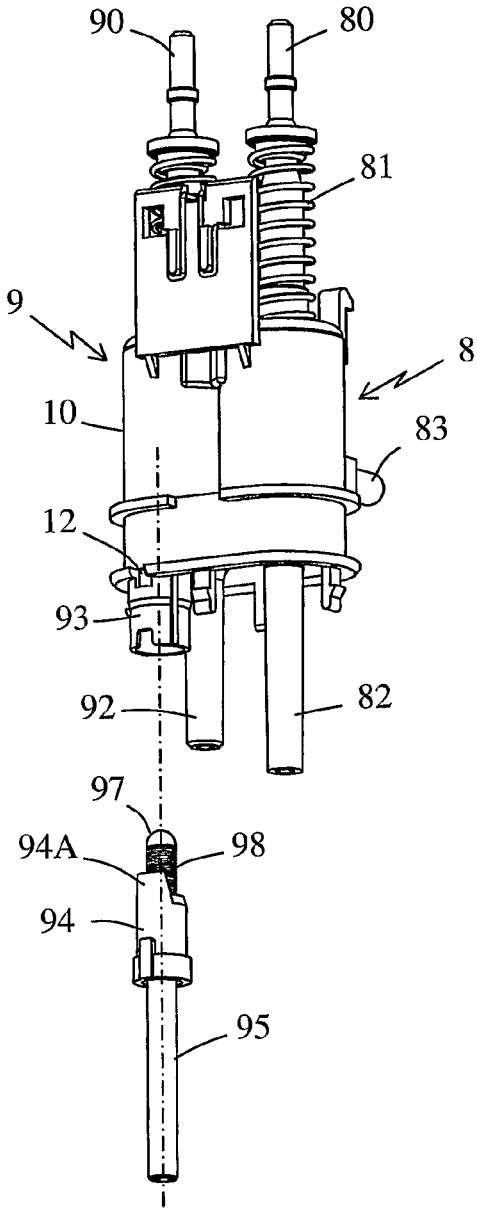
FIG. 4 is a partially exploded perspective view of the pump of FIG. 3

According to FIGS. 3 and 4, these two manual pumps 8, 9 are carried by the same body 10 disposed within the enclosure of tank 5, this body 10 having two cylinders in parallel in which slides a piston fixed to an actuating rod 80, 90, each rod being returned to a raised position by a spring 81, 91.

These two pumps 8, 9 contain respectively an inlet conduit 82, 92, the end of which is equipped conventionally with a ball valve permitting introduction of water into body 10 during lifting of the piston body and blocking the passage of water through inlet conduit 82, 92 during descent of the piston.

Inlet conduit 92 of second 9 pump is advantageously connected to a tube, not shown in the figures, opening at the rear of tank 5 so that 9 pump remains supplied with water when the iron is disposed vertically, for example to smooth curtains.

According to FIGS. 3 to 6, first pump 8 has an outlet conduit 83 opening laterally to body 10 and second 9 pump has an outlet orifice 9B provided with a connection sleeve 93 opening vertically to the base of body 10.

Connection sleeve 93 receives a sealing joint 94, advantageously made of silicone or neoprene material, ensuring a watertight connection with a supply tube 95 opening at the top of the second steam chamber 11 at the level of a second sealing joint 96, shown in FIGS. 1 and 2.

In order to prevent the steam produced in the second steam chamber 11 from flowing back into second pump 9, outlet orifice 9B is fitted with a ball valve having a ball 97 urged against outlet orifice 9B by a spring 98 extending between ball 97 and sealing joint 94.

More particularly according to the invention, the supply circuit of second steam chamber 11 includes a safety device protecting the tank against overpressures that could come about if the temperature rose significantly in tank 5 while the drip valve was closed as well as trap 7 of the tank.

This safety device is constituted by an opening 12 blocked by a valve capable of unblocking a passage through said opening 12 when the pressure reigning in tank 5 reaches a predetermined value.

Figure 5:
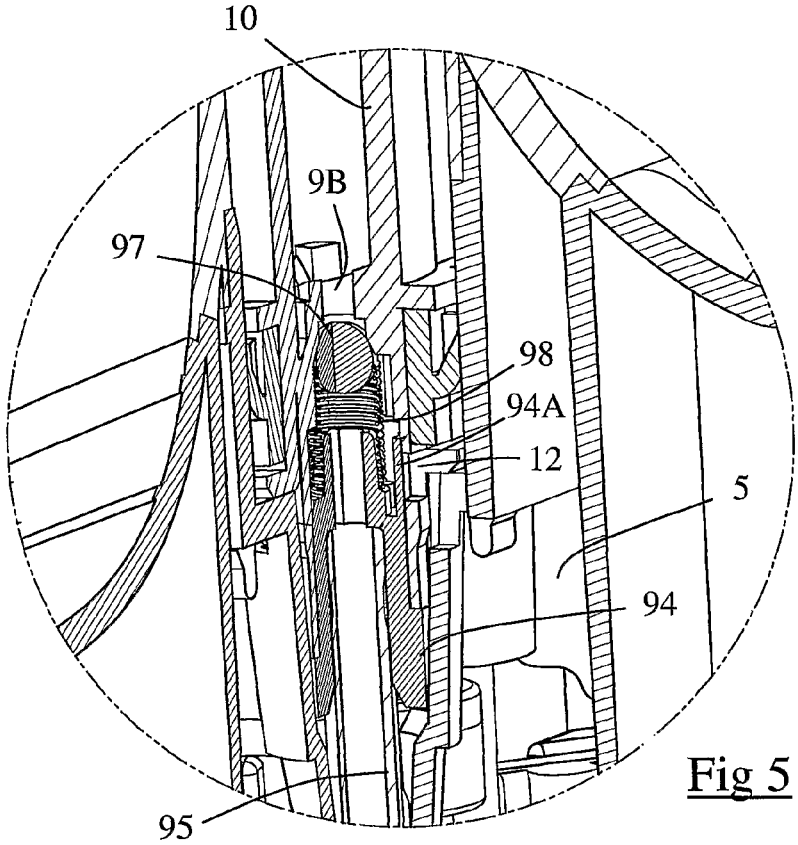
FIG. 5 is a detail view, to a larger scale, of the output area of the pump shown in FIG. 2, the pressure in the tank being lower than the opening threshold of the valve.
Figure 6:
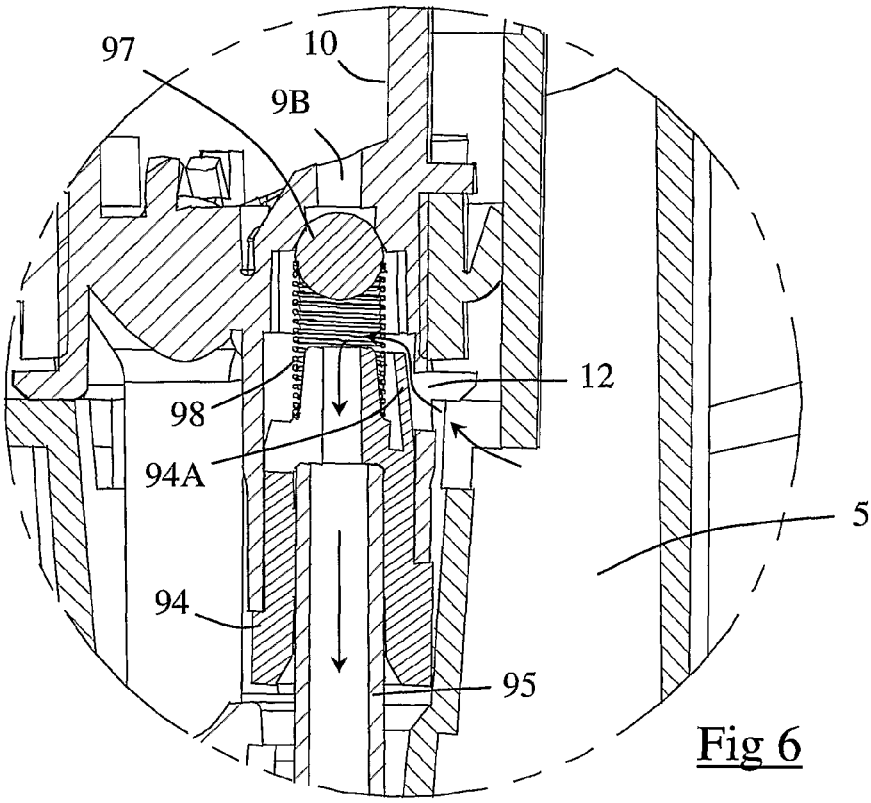
FIG. 6 is a detail view, in cross section, of the output area of the pump when the pressure in the tank exceeds the threshold of opening of the valve.

According to FIGS. 5 and 6, opening 12 is provided in connection sleeve 93 of second 9 pump and the valve is advantageously constituted by a wall 94A forming an integral part of watertight joint 94. Wall 94A extends to the upper end of watertight joint 94, to come in front of opening 12, and at the interior of connection sleeve 93 while mating with the cylindrical form of the internal bore of the latter.

For example, opening 12 of connection sleeve 93 has the form of a square 2 mm on a side and wall 94A presents the form of a tab, or tongue, with a thickness of the order of 0.4 mm, a height of the order of 3 mm and a width of the order of 3 mm decreasing gradually from the base of the tongue toward its free end.

The importance of such a wall is that it ensures a sealed closing of opening 12 during use of second pump 9 for the production of steam, the pressure of steam generated in the second steam chamber 11 having a tendency to maintain wall 94A applied against the edges of opening 12 thus assuring a perfect steam seal, as illustrated in FIG. 5.

Conversely, when the iron is used as a dry iron with the drip valve closed and heating of tank 5 provokes an elevation of pressure from a predetermined value, for example of the order of 5 to 30 mbar, then the pressure applied on wall 94A is such that this latter deforms toward the interior of connection sleeve 93 thus allowing the escape of air and possible water droplets in the direction of second steam chamber 11, as represented by the arrows in FIG. 6.

Possible water droplets carried by the steam are then fully vaporized in steam chamber 11, and steam escapes gradually through outlet holes 2A of the soleplate, without surprising the user.

Of course, the invention is in no way limited to the embodiment described and shown that was given only as an example. Modifications remain possible from the point of view of the constitution of the various elements or by substitution of technical equivalents without leaving the field of protection of the invention.

Thus, in a variant of construction the opening may be provided on the conduit connecting the connection sleeve of the pump to the second steam chamber.

The invention claimed is:

1. Steam iron comprising a housing (1) enclosing a tank (5) above a heating body (3) and a safety device protecting the tank (5) against overpressure, the heating body (3) having a steam chamber (11) supplied with liquid from the tank (5) by a supply circuit, wherein said supply circuit, has an element (93) extending to the interior of the tank (5) and having an opening (12) blocked by a valve (94A), said valve (94A) unblocking a passage through said opening (12) when the pressure reigning at the interior of the tank (5) reaches a predetermined value, wherein said supply circuit connects a manual pump (9) to the steam chamber (11), said pump (9) being equipped with a check valve (97, 98) and said opening (12) is disposed downstream of the check valve (97, 98).

2. Iron according to claim 1, wherein said element having the opening (12) blocked by valve (94A) is a connection sleeve (93) of the outlet of the pump (9).

3. Iron according to claim 2, wherein said valve is formed by a wall (94A) capable of deforming elastically when the pressure reigning at the interior of the tank (5) reaches said predetermined value.

4. Iron according to the claim 3, wherein said wall (94A) is carried by a rubber body (94).

5. Iron according to claim 4, wherein said rubber body is a sealing joint (94).

6. Iron according to claim 1, wherein said valve is formed by a wall (94A) capable of deforming elastically when the pressure reigning at the interior of the tank (5) reaches said predetermined value.

7. Iron according to the claim 6, wherein said wall (94A) is carried by a rubber body (94).

8. Iron according to claim 7, wherein said rubber body is a sealing joint (94).

9. Steam iron comprising a housing (1) enclosing a tank (5) above a heating body (3) and a safety device protecting the tank (5) against overpressure, the heating body (3) having a steam chamber (11) supplied with liquid from the tank (5) by a supply circuit, wherein said supply circuit, has an element (93) extending to the interior of the tank (5) and having an opening (12) blocked by a valve (94A), said valve (94A) unblocking a passage through said opening (12) when the pressure reigning at the interior of the tank (5) reaches a predetermined value, wherein said supply circuit connects a pump (9) or a drip valve, to the steam chamber (11), and wherein said valve is formed by a wall (94A) capable of deforming elastically when the pressure reigning at the interior of the tank (5) reaches said predetermined value.

10. Iron according to the claim 9, wherein said wall (94A) is carried by a rubber body (94).

11. Iron according to claim 10, wherein said rubber body is a sealing joint (94).

12. Steam iron comprising a housing (1) enclosing a tank (5) above a heating body (3) and a safety device protecting the tank (5) against overpressure, the heating body (3) having a steam chamber (11) supplied with liquid from the tank (5) by a supply circuit, wherein said supply circuit, has an element (93) extending to the interior of the tank (5) and having an opening (12) blocked by a valve (94A), said valve (94A) unblocking a passage through said opening (12) when the pressure reigning at the interior of the tank (5) reaches a predetermined value, wherein said valve is formed by a wall (94A) capable of deforming elastically when the pressure reigning at the interior of the tank (5) reaches said predetermined value.

13. Iron according to the claim 12, wherein said wall (94A) is carried by a rubber body (94).

14. Iron according to claim 13, wherein said rubber body is a sealing joint (94).

* * * * *